US007995708B2

(12) United States Patent
Andrews et al.

(10) Patent No.: US 7,995,708 B2
(45) Date of Patent: Aug. 9, 2011

(54) X-RAY TUBE BEARING SHAFT AND HUB

(75) Inventors: Gregory C. Andrews, Draper, UT (US); Ricky Smith, Sandy, UT (US); Santosh Ramachandran, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/541,789

(22) Filed: Aug. 14, 2009

(65) Prior Publication Data

US 2011/0038459 A1 Feb. 17, 2011

(51) Int. Cl.
*H01J 35/00* (2006.01)

(52) U.S. Cl. ..... 378/131

(58) Field of Classification Search ..... 378/131, 378/132

See application file for complete search history.

(56) References Cited

U.S. PATENT DOCUMENTS

2003/0021378 A1* 1/2003 Noonan et al. ..... 378/132
2003/0131678 A1* 7/2003 Noguchi et al. ..... 74/434
2003/0215059 A1* 11/2003 Higgins et al. ..... 378/132

* cited by examiner

*Primary Examiner* — Chih-Cheng G Kao
(74) *Attorney, Agent, or Firm* — Maschoff Gilmore & Israelsen

(57) ABSTRACT

In one example, an assembly comprises a hub and a shaft. The hub defines an axis of rotation and includes first and second flanges that at least partly define a substantially cylindrical hub opening. The shaft is connected to the hub and includes a first end and a shaft cavity. The first end is received within the hub opening. The shaft cavity is formed in the first end and includes a bottom having a substantially curved transition area.

15 Claims, 5 Drawing Sheets

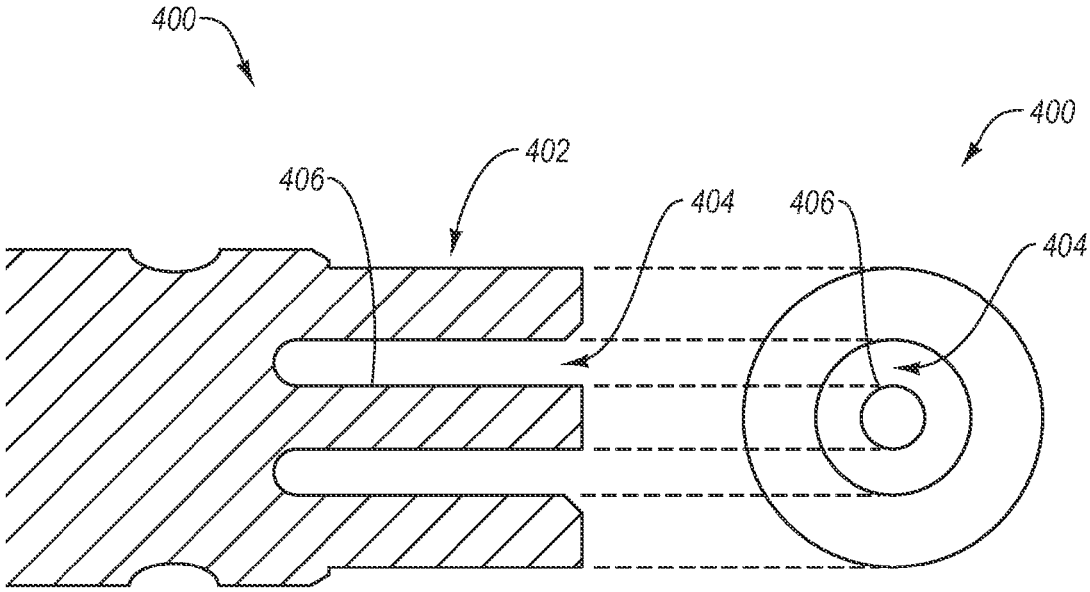
Fig. 4A
Fig. 4B
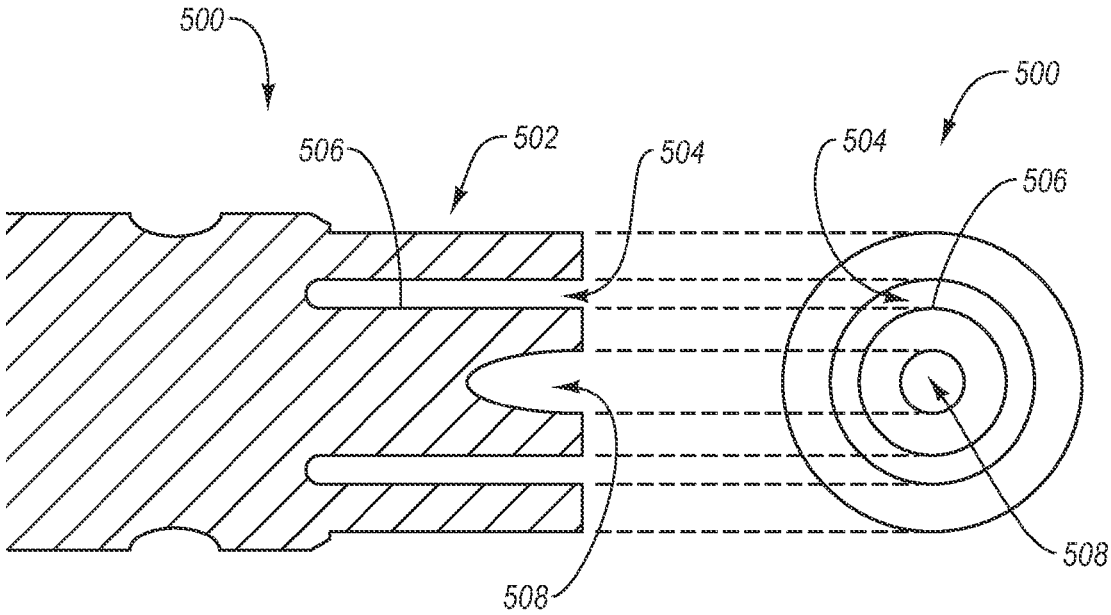
Fig. 5A
Fig. 5B

X-RAY TUBE BEARING SHAFT AND HUB

BACKGROUND

1. Field of the Invention

Embodiments of the present invention generally relate to x-ray tubes. In particular, some example embodiments relate to an x-ray tube bearing assembly having a two-piece hub and shaft.

2. Related Technology

The x-ray tube has become essential in medical diagnostic and inspection imaging, medical therapy, and various medical testing and material analysis industries. Such equipment is commonly employed in areas such as medical and industrial diagnostic examination, therapeutic radiology, semiconductor fabrication, and materials analysis.

An x-ray tube typically includes a vacuum enclosure that contains a cathode assembly and an anode assembly. The vacuum enclosure may be composed of metals, glass, ceramic, or a combination thereof, and is typically disposed within an outer housing. A cooling medium, such as a dielectric oil or similar coolant, can be disposed in the volume existing between the outer housing and the vacuum enclosure in order to dissipate heat from the surface of the vacuum enclosure. The cathode assembly generally consists of a metallic cathode head assembly and a source of electrons highly energized for generating x-rays. The anode assembly, which is generally manufactured from a refractory metal such as tungsten, includes a focal track that is oriented to receive electrons emitted by the cathode assembly.

Some x-ray tubes include a rotating anode. Rotating anode x-ray tubes often utilize a precision high performance bearing assembly coupled to the anode assembly to allow rotation of the anode. Such bearing assemblies can be comprised of one or more bearing rings, ball sets, a shaft, and a hub. In some cases, the hub is made from different material(s) than the shaft. The difference in material(s) between the hub and the shaft may put a considerable amount of stress on the shaft-to-hub interface.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF SOME EXAMPLE EMBODIMENTS

In general, example embodiments of the invention relate to a two-piece x-ray tube bearing assembly having a hub and shaft.

In one example embodiment, an assembly comprises a hub and a shaft. The hub defines an axis of rotation and includes first and second flanges that at least partly define a substantially cylindrical hub opening. The shaft is connected to the hub and includes a first end and a shaft cavity. The first end is received within the hub opening. The shaft cavity is formed in the first end and includes a bottom having a substantially curved transition area.

In another example embodiment, an x-ray tube comprises an anode, a stem assembly, and a bearing assembly. The stem assembly is coupled to the anode. The bearing assembly rotatably supports the anode and the stem assembly and includes a hub, a shaft, lower and upper bearing rings, lower and upper ball sets, and a bearing housing. The hub is coupled to the stem assembly and defines a hub opening and an axis of rotation. The shaft is connected to the hub and includes a first end and a shaft cavity. The first end is received within the hub opening. The shaft cavity is formed in the first end and includes a bottom having a substantially curved transition area. The lower and upper bearing rings cooperate with the shaft to define lower and upper races. The lower and upper ball sets are disposed in the lower and upper races. The bearing housing is configured to receive the lower and upper bearing rings, lower and upper ball sets, and a portion of the shaft.

In yet another example embodiment, an x-ray tube comprises an anode, a stem assembly, and a bearing assembly. The stem assembly is coupled to the anode. The bearing assembly rotatably supports the anode and the stem assembly and includes a hub, a shaft, lower and upper bearing rings, lower and upper ball sets, and a bearing housing. The hub is coupled to the stem assembly and defines an axis of rotation. The hub includes first and second flanges that at least partly define a substantially cylindrical hub opening. The shaft includes a first end disposed within the hub opening and the shaft is connected to the hub at an interface between the first end and the first and second flanges. The lower and upper bearing rings cooperate with the shaft to define lower and upper races. The lower and upper ball sets are disposed in the lower and upper races. The bearing housing is configured to receive the lower and upper bearing rings, lower and upper ball sets, and a portion of the shaft.

These and other aspects of example embodiments will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIGS. 4A-4B show a cross-sectional side view and end view of another embodiment of a shaft; and FIGS. 5A-5B show a cross-sectional side view and end view of yet another embodiment of a shaft.

DETAILED DESCRIPTION OF THE PREFERRED EMBODIMENTS

Embodiments of the present invention are generally directed to a two-piece bearing assembly that includes a hub and a shaft. Some example embodiments include a hub and a shaft, the hub having two flanges bounding a hub opening and extending in opposite directions parallel to an axis of rotation of the bearing assembly. The inclusion of two flanges on the hub can increase the contact area and retention force between the hub and the shaft compared to hubs that include a single flange. The shaft includes a shaft cavity formed at one end of the shaft. The shaft cavity allows the shaft to flex radially inward to accommodate thermal expansion of the hub during operation. The increased contact area and retention force provided by the second flange and/or the shaft cavity formed in the shaft may lower stresses on the hub in some embodiments.

Reference will now be made to the figures wherein like structures will be provided with like reference designations. It is understood that the figures are diagrammatic and schematic representations of some embodiments of the invention, and are not limiting of the present invention, nor are they necessarily drawn to scale.

I. X-Ray Devices

Figure 1:
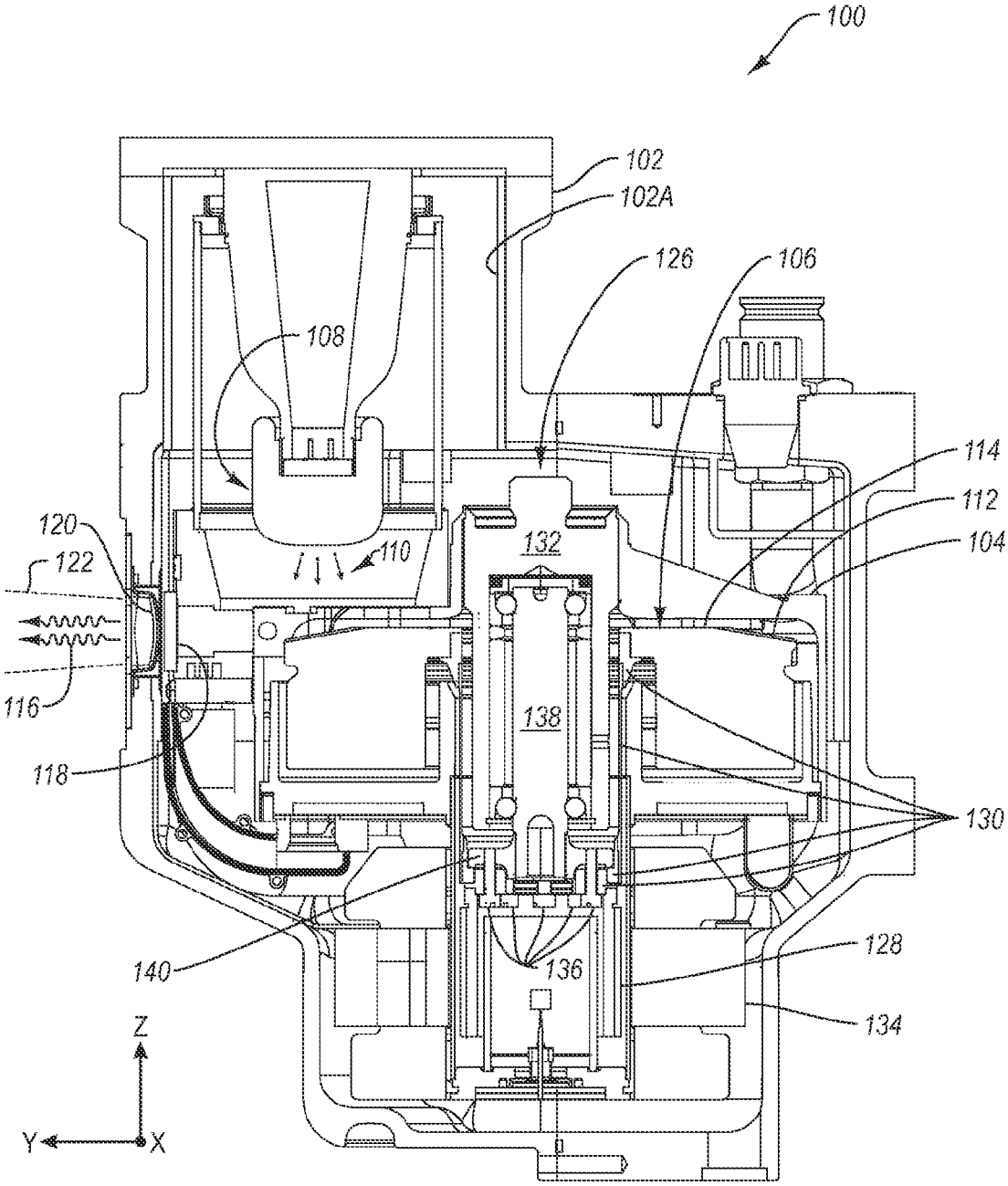
FIG. 1 is a simplified cross-sectional depiction of an x-ray tube incorporating a bearing assembly according to an embodiment of the invention.

Reference is first made to FIG. 1, which depicts one possible environment wherein embodiments of the present invention can be practiced. Particularly, FIG. 1 shows an x-ray tube, designated generally at 100, which serves as one example of an x-ray generating device. The x-ray tube 100 generally includes an outer housing 102, within which is disposed an evacuated enclosure 104. A cooling fluid (not shown) is also disposed within the outer housing 102 and circulates around the evacuated enclosure 104 to assist in x-ray tube cooling and to provide electrical isolation between the evacuated enclosure 104 and the outer housing 102. In some embodiments, the cooling fluid may comprise dielectric oil, which exhibits desirable thermal and electrical insulating properties for some applications, although cooling fluids other than dielectric oil can alternately or additionally be implemented in the x-ray tube 100.

In some embodiments, the outer housing 102 includes x-ray shielding 102A that is positioned so as to prevent unintended x-ray emission from the x-ray tube 100 during operation. Note that, in other embodiments, the x-ray shielding 102A is not included with the outer housing 102, but rather might be joined to the evacuated enclosure 104. In yet other embodiments, the x-ray shielding 102A may be included neither with the outer housing 102 nor the evacuated enclosure 104, but may be included in another predetermined location.

Disposed within the evacuated enclosure 104 are an anode 106 and a cathode 108. The anode 106 is spaced apart from and oppositely disposed to the cathode 108, and may be at least partially composed of a thermally conductive material such as copper or a molybdenum alloy. The anode 106 and cathode 108 are connected in an electrical circuit that allows for the application of a high voltage potential between the anode 106 and the cathode 108. The cathode 108 includes a filament (not shown) that is connected to an appropriate power source and, during operation, an electrical current is passed through the filament to cause electrons, designated at 110, to be emitted from the cathode 108 by thermionic emission. The application of a high voltage differential between the anode 106 and the cathode 108 then causes the electrons 110 to accelerate from the cathode filament toward a focal track 112 that is positioned on a target 114 of the anode 106. The focal track 112 is typically composed of tungsten or other material(s) having a high atomic ("high Z") number. As the electrons 110 accelerate, they gain a substantial amount of kinetic energy, and upon striking the target material on the focal track 112, some of this kinetic energy is converted into electromagnetic waves of very high frequency, i.e., x-rays 116, shown in FIG. 1.

The focal track 112 is oriented so that emitted x-rays 116 are directed toward an evacuated enclosure window 118. The evacuated enclosure window 118 is comprised of an x-ray transmissive material and is positioned within a port defined in a wall of the evacuated enclosure 104 at a point aligned with the focal track 112. An outer housing window 120 is disposed so as to be at least partially aligned with the evacuated enclosure window 118. The outer housing window 120 is similarly comprised of an x-ray transmissive material and is disposed in a port defined in a wall of the outer housing 102. The x-rays 116 that emanate from the evacuated enclosure 104 and pass through the outer housing window 120 may do so substantially as a conically diverging beam, the path of which is generally indicated at 122 in FIG. 1.

The anode 106 is rotatably supported by an anode support assembly that generally comprises a bearing assembly 126, a rotor sleeve 128, and a stem assembly 130. The bearing assembly 126 includes a housing 132. The housing 132 is fixedly attached to a portion of the evacuated enclosure 104 such that the anode 106 is rotatably supported within the evacuated enclosure 104 by the bearing assembly 126 via the stem assembly 130, such that the anode 106 is able to rotate with respect to the bearing housing 132. A stator 134 is disposed about the rotor sleeve 128 and utilizes rotational electromagnetic fields to cause the rotor sleeve 128 to rotate. The rotor sleeve 128 is attached to the anode 106 via the stem assembly 130 and a plurality of fasteners 136, thereby providing the needed rotation of the anode 106 during operation of the x-ray tube 100.

In operation, the flow of the electrons 110 from the cathode 108 to the anode 106 transports large amounts of energy to the anode 106. The majority of the energy transported to the anode 106 takes the form of thermal energy, or heat. Accordingly, the anode 106 and various other components connected to the anode 106, such as the stem assembly 130, may comprise refractory materials that retain their strength at high temperatures. Such refractory materials are typically characterized by a relatively low coefficient of thermal expansion ("CTE"), which generally means that the materials expand/contract less per degree of temperature change than materials characterized by relatively higher CTEs. In some embodiments, refractory materials employed in the stem assembly 130 have a CTE of approximately 5e-6/K at 20° C.

The anode 106 is rotated so as to distribute the thermal energy around the target 114. The rotation of the anode 106, the stem assembly 130, the rotor sleeve 128, and other components connected to the anode 106, places substantial loads on the bearing assembly 126. All or a portion of the bearing assembly 126, such as a shaft 138 of the bearing assembly, often comprises hardened steel so as to support the loads generated by the rotating components. Hardened steel may be characterized by a relatively high CTE. In some embodiments, for example, the shaft 138 and/or other components employed in the bearing assembly 126 have a CTE of approximately 12e-6/K at 20° C.

Thus, in some applications, the anode 106 and stem assembly 130 are made from refractory materials having a relatively low CTE to withstand high operating temperatures of the anode 106 and/or the stem assembly 130, while the shaft 138 is made from hardened steel or other materials having a relatively high CTE to support the loads on the bearing assembly 126. To accommodate the resulting mismatch in CTEs between the stem assembly 130 and the shaft 138, and thereby minimize stress at the interface of these components with each other, the bearing assembly 126 can include a hub 140 comprising a material having a CTE that is in between the CTEs of the stem assembly 130 and the shaft 138. Aspects of a bearing assembly such as may be employed in the x-ray tube 100 of FIG. 1 are disclosed in greater detail below.

FIG. 1 discloses one example environment in which a bearing assembly 126 according to embodiments of the invention might be utilized. However, it will be appreciated that there are many other x-ray tube configurations and environments for which embodiments of the bearing assembly 126 would find use and application.

II. Bearing Assembly

Figure 2A:
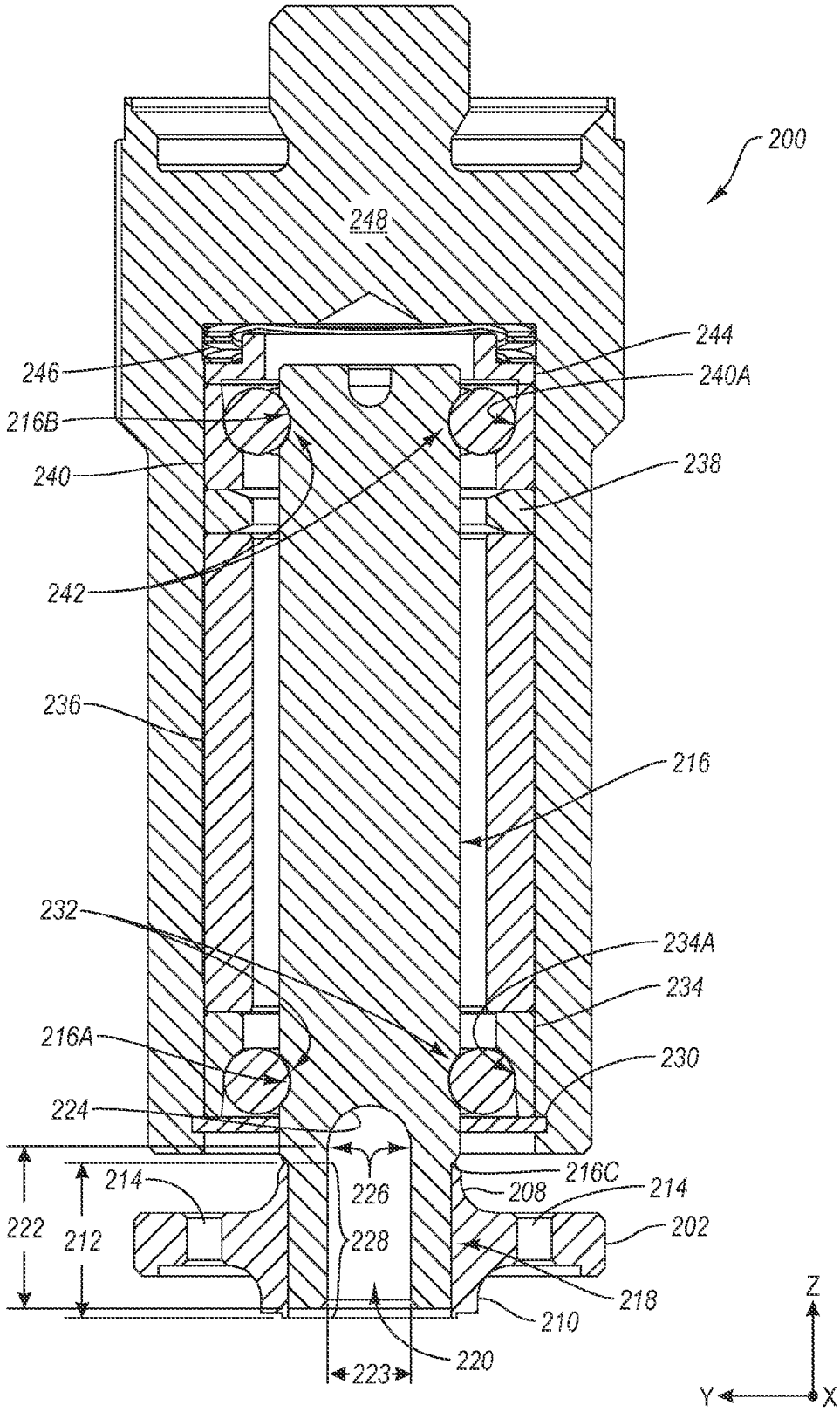
FIG. 2A is a cross-sectional view of an example bearing assembly such as may be employed in the x-ray tube of FIG. 1.
Figure 2B:
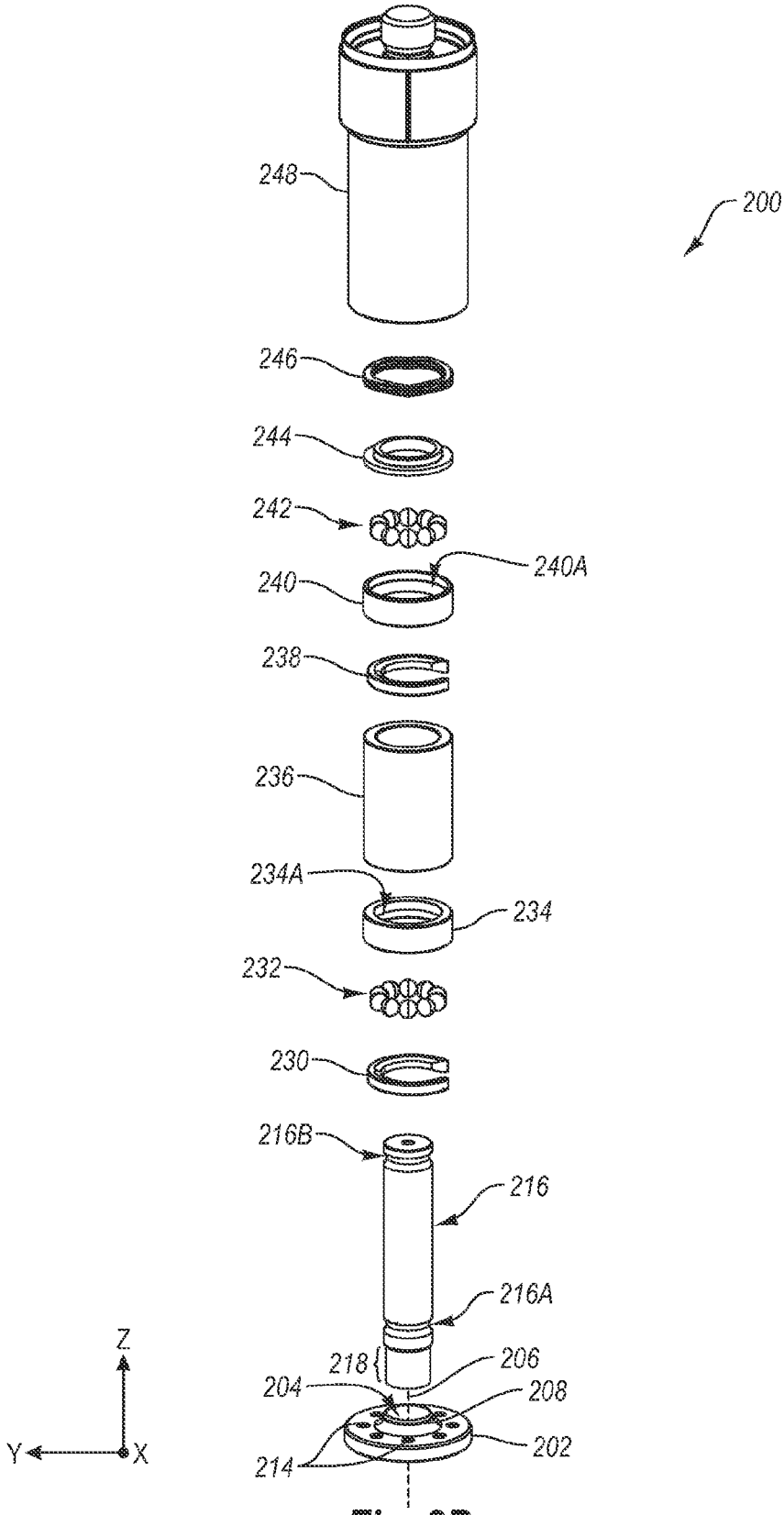
FIG. 2B is an exploded view of the bearing assembly of FIG. 2A.

With additional reference to FIGS. 2A-2B, an embodiment of a bearing assembly 200 is disclosed that may correspond to the bearing assembly 126 of FIG. 1. FIG. 2A discloses a cross-sectional view and FIG. 2B discloses an exploded view of the bearing assembly 200.

As shown, the bearing assembly 200 includes a hub 202, which may comprise a super alloy such as the super alloy marketed under the trade name Incoloy 909 alloy and generically referred to in the Unified Numbering System for Metals and Alloys ("UNS") as UNS N19909 alloy, or other suitable material(s). While the hub material(s) may vary, the CTE of the hub 202 may be higher than the CTE of a corresponding stem assembly, anode, or other rotating component to which the hub 202 is secured. In some examples, the CTE of the hub 202 is about 8e-6/K at 20° C. to 10e-6/K at 20° C. These specific values are given by way of example only, and should not be construed to limit the invention.

The hub 202 defines a substantially cylindrical hub opening 204 (FIG. 2B) and an axis of rotation 206 (FIG. 2B). Further, the hub 202 includes a first flange 208 and a second flange 210 (FIG. 2A), each of which defines a portion of the hub opening 204. The first flange 208 extends from the hub 202 in a direction that is substantially parallel to the axis of rotation 206. The second flange 210 extends from the hub 202 in the opposite direction. As shown in FIG. 2A, the first flange 208 and second flange 210 define an axial length 212 of the hub opening 204.

Optionally, the hub 202 further includes a plurality of through holes 214 formed in the hub 202. The through holes 214 are configured to receive screws, bolts, or other fasteners, such as the fasteners 136 of FIG. 1, to secure the hub 202, and thus the bearing assembly 200, to a corresponding stem assembly, anode, rotor sleeve, and/or other rotating component(s). Alternately or additionally, the hub 202 can be secured to the corresponding stem assembly, anode, rotor sleeve, and/or other rotating component(s) using adhesive or other securing means.

The bearing assembly 200 additionally includes a shaft 216, which may comprise, for example, high-temperature tool steel such as the tool steel marketed under the trade name REX 20 and generically referred to in the American Iron and Steel Institute standard ("AISI") as AISI M62 steel. Generally, the CTE of the shaft 216 is higher than the CTE of the hub 202. In some embodiments, the CTE of the shaft 216 is about 12e-6/K at 20° C. This specific value is given by way of example only, and should not be construed to limit the invention.

As shown, the shaft 216 defines a lower inner race 216A and an upper inner race 216B disposed circumferentially about the shaft 216. Lower and upper inner races 216A, 216B, in turn, can include bearing surfaces that may be coated with a solid metal lubricant or other suitable lubricant.

The shaft 216 includes a first end 218 configured to be received within the hub opening 204 and a substantially cylindrical shaft cavity 220 (FIG. 2A) formed in the first end 218. In this example embodiment, the shaft 216 includes a stop 216C which limits the extent to which the hub 202 can travel along the axis 206 during assembly. An axial length 222 (FIG. 2A) of a cylindrical portion of the shaft cavity 220 and an inner diameter 223 (FIG. 2A) of the cylindrical portion of the shaft cavity 220 are sufficient to accommodate inward radial thermal expansion of the hub 202 towards the axis 206 by allowing the first end 218 to flex radially inwards. In FIG. 2A, the axial length 222 of the shaft cavity 220 is substantially equal to the axial length 212 of the hub opening 204. In other embodiments, the axial length 222 of shaft cavity 220 is greater than or less than the axial length 212 of hub opening 204.

In some embodiments, the accommodation of the radial expansion of the hub 202 by the shaft 216 reduces stress on the hub 202, while increasing stress on the shaft 216, as compared to some two-piece hubs and shafts where the shaft lacks a shaft cavity. Accordingly, to achieve a relative reduction of the stress on the shaft 216, the shaft cavity 220 can include a bottom 224 shaped to reduce stress concentration at the interface of the hollow first end 218 with the solid portion of the shaft 216. In particular, the bottom 224 is a semispherical shape in the example of FIG. 2A. More generally, the bottom 224 can include virtually any shape with a substantially curved transition area 226, as opposed to a sharply angled transition area, that tends to reduce or minimize the stress concentration at the interface of the hollow first end 218 with the solid portion of the shaft 216.

The hub 202 is secured to the first end 218 of the shaft 216 at an interface 228 of the hub 202 with the first end 218 using any one or more of a variety of techniques. For instance, the hub 202 can be secured to the first end 218 via interference/press/friction fit, welding, brazing, or other suitable technique(s). As such, the bearing assembly 200 can include an interference fit, press fit, friction fit, weld, braze, or the like, formed at the interface 228 between the hub 202 and the first end 218.

Bearing assembly 200 additionally includes a retaining clip 230, lower ball set 232, lower bearing ring 234, spacer 236, C-ring 238, upper bearing ring 240, upper ball set 242, spring seat 244, spring 246, and housing 248. Lower bearing ring 234 defines lower outer race 234A and upper bearing ring 240 defines upper outer race 240A. Each of the lower outer race 234A and upper outer race 240A can include respective bearing surfaces that may be coated with a solid metal lubricant or other suitable lubricant.

Retaining clip 230, lower bearing ring 234, spacer 236, C-ring 238, upper bearing ring 240, spring seat 244 and spring 246 are disposed about shaft 216 so that lower outer race 234A and upper outer race 240A are substantially aligned with, respectively, lower inner race 216A and upper inner race 216B defined by shaft 216. In this way, lower outer race 234A and upper outer race 240A cooperate with, respectively, lower inner race 216A and upper inner race 216B to confine lower ball set 232 and upper ball set 242, respectively.

Both lower ball set 232 and upper ball set 242 comprise respective pluralities of balls. In general, lower ball set 232 and upper ball set 242 cooperate to facilitate high-speed rotary motion of the shaft 216, and thus of a corresponding stem assembly, anode, rotor sleeve, and/or other rotating component(s). It will be appreciated that variables such as the number and diameter of balls in each of the lower ball set 232 and upper ball set 242 may be varied as required to suit a particular application. Further, in some embodiments of the invention, each of the balls in lower ball set 232 and upper ball set 242 are coated with a solid metal lubricant or other suitable material.

Directing continuing attention to FIGS. 2A and 2B, bearing assembly 200 includes bearing housing 248, which serves to receive and securely retain lower and upper bearing rings 234, 240. In some embodiments, the bearing housing 248 defines an interior cavity substantially in the shape of a seamless cylinder and comprises a durable, high-strength metal or metal alloy, such as stainless steel or the like, that is suitable for use in high temperature x-ray tube operating environments. Spring 246, spring seat 244, upper bearing ring 240, c-ring 238, spacer 236, lower bearing ring 234 and shaft 216 are securely retained in bearing housing 248 by way of retaining clip 230, which serves to substantially foreclose axial movement of these components within bearing housing 248.

Directing continuing attention to FIGS. 2A and 2B, details are provided regarding various operational aspects of the bearing assembly 200. As mentioned above, a stator, such as stator 134 of FIG. 1, utilizes rotational electromagnetic fields to cause a rotor sleeve (not shown), such as rotor sleeve 128 (FIG. 1), to rotate. Because the rotor sleeve is connected to the shaft 216 via hub 202, which hub 202 is also connected to the anode (not shown), the rotation of the rotor sleeve causes the hub 202, shaft 216 and the anode to also rotate. In general, rotation of shaft 216 causes lower ball set 232 and upper ball set 242 to travel at high speed along, respectively, the races 216A/234A and 216B/240A cooperatively defined by shaft 216 and lower and upper bearing rings 234 and 240. The movement of the lower ball set 232 and upper ball set 242 along the races 216A/234A and 216B/240A cooperatively defined by shaft 216 and lower and upper bearing rings 234 and 240 allows the hub 202 and shaft 216 to rotate with respect to the lower and upper bearing rings 234, 240 and the bearing housing 248.

FIGS. 2A and 2B disclose one example bearing assembly in which a hub 202 and shaft 216 according to embodiments of the invention might be utilized. However, it will be appreciated that there are many other bearing assembly configurations and environments for which embodiments of the hub 202 and shaft 216 would find use and application. Accordingly, the scope of the invention is not limited to the examples disclosed in the Figures.

III. Hub and Shaft

As already mentioned above, the use of a two-piece hub 202 and shaft 216 in the bearing assembly 200 is configured to bridge the CTE mismatch between the shaft 216 and a corresponding stem assembly, such as the stem assembly 130 of FIG. 1, and to thereby reduce stress at the interface of the stem assembly with the bearing assembly 200. In some embodiments, the hub 202 is made from a material having a lower yield stress than a material from which the shaft 216 is made. Accordingly, some embodiments disclosed herein, as compared to some bearing assemblies, are configured to reduce stress on the hub 202 and increase stress on the shaft 216 while maintaining a sufficient safety factor in both the hub 202 and shaft 216 to avoid failure of the hub 202 or shaft 216.

Unless otherwise noted, the stresses on the hub 202 and shaft 216 are discussed as percentages of yield stress. For instance, the stress on the hub 202, shaft 216 or other component refers to an actual stress on the corresponding component in application—either an actual measured stress or an actual modeled stress—divided by the theoretical yield stress of the component. Yield stress refers to the stress at which the component begins to deform plastically. Accordingly, any stress of 100% or greater on a component indicates that the component has failed or is likely to fail in a particular application.

Safety factor is the inverse of stress. More particularly, the safety factor for a component refers to the theoretical yield stress of the component divided by the actual stress on the component in application. Any safety factor above 1 indicates that a component did not fail or is not likely to fail in a particular application.

Figure 3:
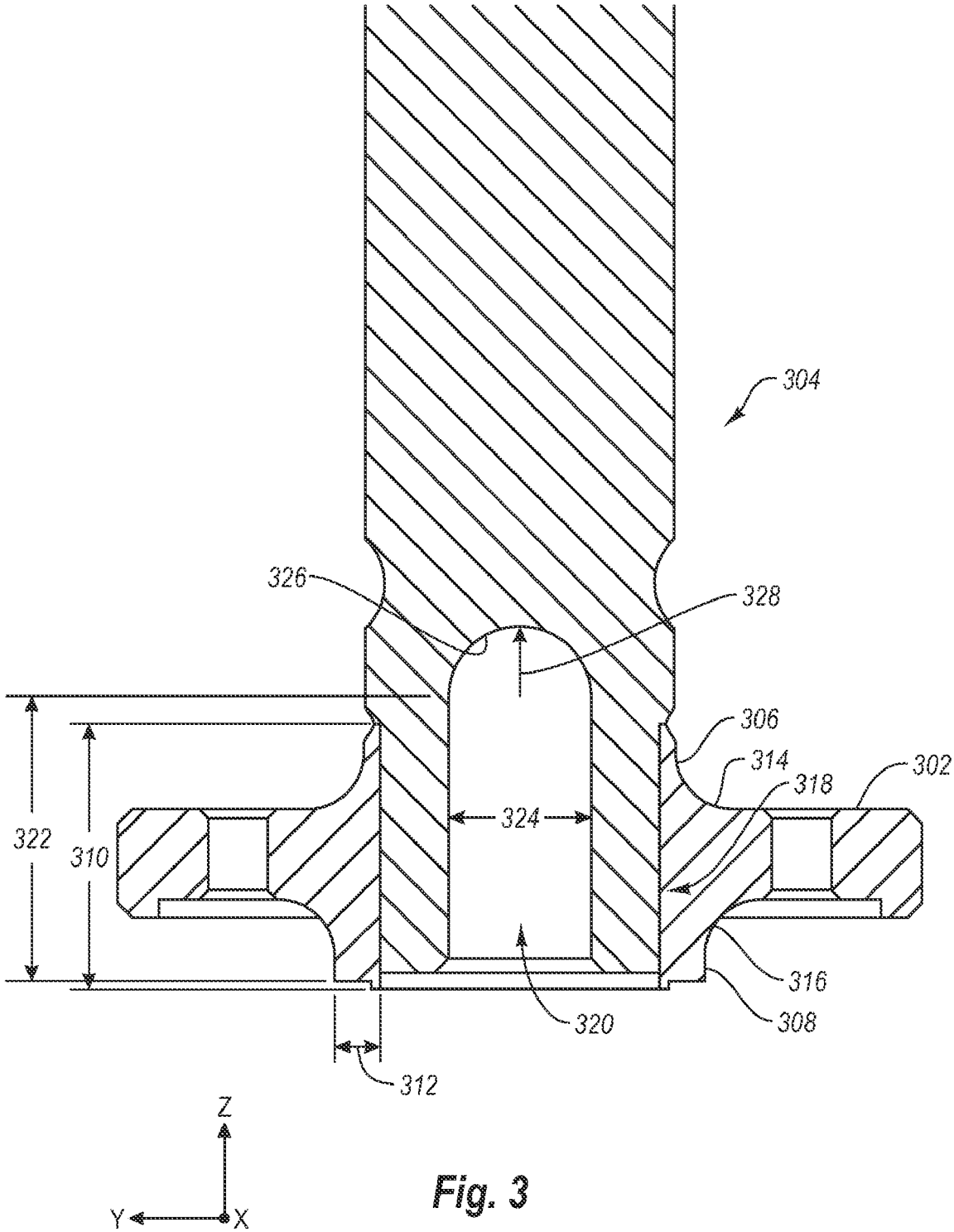
FIG. 3 is a cross-sectional view of a hub and shaft such as may be employed in the bearing assembly of FIG. 2A.

Turning next to FIG. 3, additional details regarding an example hub 302 and shaft 304 are disclosed. The hub 302 and shaft 304 may correspond, respectively, to the hub 202 and shaft 216 of FIGS. 2A and 2B. FIG. 3 discloses a cross-sectional view of the hub 302 and shaft 304.

Various specific values are provided below that describe parameters of the hub 302 and shaft 304. The specific values provided herein are given by way of example only and should not be construed to limit the invention. Indeed, embodiments of the invention include bearing assemblies with hubs and shafts that have different parametric values than are provided below.

As shown in FIG. 3, the hub 302 includes a first flange 306 and a second flange 308 defining an axial length 310 of the hub 302. In the present example, the axial length 310 of the hub 302 is about 18.1 millimeters ("mm"), although the axial length 310 of the hub 302 can be greater or less than 18.1 mm in other examples. A thickness 312 of the second flange 308 is substantially equal to 3.2 mm. In other embodiments, the thickness 312 of the second flange is substantially equal to 3.5 mm. In yet other embodiments, the thickness 312 of the second flange 308 is greater than or equal to 2 mm, or even less than 2 mm.

FIG. 3 further discloses a first fillet 314 formed between the first flange 306 and the hub 302, and a second fillet 316 formed between the second flange 308 and the hub 302. In some examples, one or both of the first and second fillets 314, 316 has a radius substantially equal to 4 mm. In other embodiments, the first and second fillets 314, 316 have radii of more or less than 4 mm. Further, the first fillet 314 can have the same or a different radius than the second fillet 316. Correspondingly, the respective geometries of the first and second flanges 306, 308 can be the same, or different.

As compared to some bearing assemblies having hubs without a second flange, the inclusion of the second flange 308 in the hub 302 increases contact area between the hub 302 and the shaft 304. Whereas a retention force between the hub 302 and shaft 304 is proportional to the contact area between the two components, the increased contact area between hub 302 and shaft 304 increases the retention force between the hub 302 and shaft 304 compared to some bearing assemblies. Additionally, the second flange 308 increases the effective moment arm of the hub 302 which decreases the required force at the hub 302 to counteract applied torque during operation compared to some bearing assemblies. Accordingly, the second flange 308 is configured to, at least in part, strengthen the hub 302 sufficiently to withstand stress such that the hub 302 has a safety factor greater than 1.

Further, the thickness 312 of the second flange 308 and the radii of the first and second fillets 314, 316 are parameters that can be selected so as to obtain a desired safety factor for the hub 302 and shaft 304. For instance, in some examples, the thickness 312 of the second flange 308 is selected to be about 3.5 mm and the radii of the first and second fillets 314, 316 are selected to be about 4 mm, resulting in a factor of safety greater than one for each of the hub 302 and shaft 304 according to some embodiments.

A. Safety Factor

The safety factor of a component is determined in one or more of a variety of different instances. For instance, a safety factor for the hub 302, shaft 304, or other component can be determined (1) during bake out and compared to yield stress of the component, (2) during gantry operation and compared to yield stress of the component, and (3) during gantry operation and compared to fatigue strength of the component.

Bake out refers to a process that can be performed during the manufacture of an x-ray tube in which the hub 302 is heated to a maximum temperature, which may be 500° C. in some examples. Gantry operation refers to operation of an x-ray tube on a rotating gantry such as may be used in CT scanner applications. During gantry operation, the hub 302 is heated to 400° C. while determining the safety factor. Fatigue strength of a component refers to the value of stress at which failure of the component occurs after N loading cycles of the component. The safety factor with respect to fatigue strength is determined in some examples by considering multiple criteria, including Signed Von Mises stress and Maximum Principal Stress.

In some examples where the thickness 312 of the second flange is about 3.5 mm and the radii of the first and second fillets 314, 316 are each about 4 mm, the safety factor of the hub 302 compared to yield stress is about 1.1 at bake out and about 1.3 at gantry operation, while the safety factor of the hub 302 compared to fatigue strength at gantry operation is about 1 using the Signed Von Mises stress criterion and is about 1.5 using the Maximum Principal Stress criterion. Accordingly, a general range of safety factor for the hub 302 compared to yield stress and fatigue strength and that encompasses bake out and gantry operation is, in some embodiments, greater than or equal to 1 and less than or equal to 1.5. In other embodiments, the general safety factor for the hub 302 falls within a different range than 1 to 1.5 and/or is greater than 1.5.

Returning to FIG. 3, the shaft 304 includes a first end 318 and a substantially cylindrical shaft cavity 320 formed in the first end 318. As shown, an axial length 322 of a cylindrical portion of the shaft cavity 320 is about 19.4 mm, which is substantially equal to the axial length 310 (18.1 mm) of the hub 302, although the axial length 322 of the cylindrical portion of the shaft cavity 320 can be greater or less than 19.4 mm in other embodiments. The shaft cavity 320 defines an inner diameter 324 of about 10 mm in the example of FIG. 3. The shaft cavity 320 also includes a bottom 326 having a substantially semispherical shape with a radius 328 of about 5 mm in the example of FIG. 3, although the bottom 326 can have virtually any other curved shape such as parabolic, elliptical, or the like. Further, the values of the inner diameter 324 and radius 328 can be different than 10 mm and 5 mm, respectively, in other embodiments.

As compared to some bearing assemblies having substantially solid shafts, the shaft cavity 320 reduces the stiffness of the shaft 304 at first end 318, allowing the shaft 304 to flex inward to accommodate inward radial expansion of the hub 302 and thereby reduce stress on the hub 302. At the same time, the decrease in stiffness of the shaft 304 results in an increase in stress on the shaft 304, although the maximum stress remains below 100% of the yield stress of the shaft 304. In some embodiments, the shaft 304 is configured to experience maximum stress substantially equal to the maximum stress experienced by the hub 302 such that the shaft 304 has a safety factor that is substantially equal to the safety factor of the hub 302.

IV. Alternative Embodiments

In the illustrated embodiment of FIG. 3, the inner diameter 324 is substantially uniform along the axial length 322 of the cylindrical portion of the shaft cavity 320. In other embodiments, rather than the shaft cavity 320 being substantially cylindrical, the shaft cavity 320 can be substantially conical such that the inner diameter 324 of the shaft cavity 320 varies axially. Alternately, the shaft cavity 320 can have other shapes besides substantially cylindrical or substantially conical.

Some embodiments have been described herein in the context of a bearing assembly for use in an x-ray device, the bearing assembly having a hub with first and second flanges and a shaft with a cavity formed in the end received by the hub. Alternately, embodiments of the invention include bearing assemblies used in operating environments other than x-ray devices. Embodiments of the invention additionally include bearing assemblies having a hub with first and second flanges and a shaft that is substantially solid at the end received by the hub, as well as bearing assemblies having a hub with a single flange, or no flanges at all, and a shaft that has a cavity formed in the end received by the hub.

Further, in the embodiments disclosed in FIGS. 2A-3, the shaft 216, 304 has been illustrated as including a completely hollow first end 218, 318. However, embodiments of the invention alternately or additionally include shafts having first ends that are only partially hollow. For instance, FIGS. 4A and 4B disclose, respectively, a cross-sectional side view and an end view of a shaft 400 having a first end 402 (FIG. 4A) that is partially hollow. In particular, a substantially cylindrical shaft cavity 404 is formed in the first end 402, and a post 406 is disposed within the substantially cylindrical shaft cavity 404. FIGS. 5A and 5B disclose, respectively, a cross-sectional side view and an end view of another example of a shaft 500 having a first end 502 (FIG. 5A) that is partially hollow. In particular, a first substantially cylindrical shaft cavity 504 is formed in the first end 502, a post 506 is disposed within the first substantially cylindrical shaft cavity 504, and a second substantially cylindrical shaft cavity 508 is formed in the post 506.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube assembly comprising:

a hub defining an axis of rotation, the hub including first and second flanges that at least partly define a substantially cylindrical hub opening; and a shaft connected to the hub, the shaft including:

a first end received within the hub opening; and a shaft cavity formed in the first end and including a bottom having a substantially curved transition area.

2. The x-ray tube assembly of claim 1, wherein the hub has a first coefficient of thermal expansion and the shaft has a second coefficient of thermal expansion that is greater than the first coefficient of thermal expansion.

3. The x-ray tube assembly of claim 1, wherein the shaft comprises high temperature tool steel including one or more of AISI M62 steel or REX 20 steel.

4. The x-ray tube assembly of claim 1, wherein the hub comprises a super alloy including one or more of UNS N19909 alloy or Incoloy 909 alloy.

5. The x-ray tube assembly of claim 1, further comprising at least one of the following formed between the shaft and the hub at an interface between the first end of the shaft and the first and second flanges: a press fit, a friction fit, a weld, or a braze.

6. The x-ray tube assembly of claim 1, wherein a safety factor of the hub is substantially equal to a safety factor of the shaft.

7. The x-ray tube assembly of claim 1, wherein a safety factor of the hub is greater than or equal to 1.0.

8. The x-ray tube assembly of claim 1, wherein an axial length of a cylindrical portion of the shaft cavity is substantially equal to an axial length of the hub opening.

9. The x-ray tube assembly of claim 1, further comprising:

lower and upper bearing rings which cooperate with the shaft to define lower and upper races;

a spacer and a C-ring interposed between the lower and upper bearing rings;

a spring seat and a spring disposed at a second end of the shaft, the second end being opposite the first end;

a lower ball set disposed in the lower race and an upper ball set disposed in the upper race;

a bearing housing configured to receive the lower and upper bearing rings, the lower and upper ball sets, the spacer, the C-ring, the spring seat, the spring, and a portion of the shaft; and a retaining clip configured to retain the lower and upper bearing rings, the lower and upper ball sets, the spacer, the C-ring, the spring seat, the spring, and the portion of the shaft within the bearing housing.

10. An x-ray tube, comprising:

an anode;

a stem assembly coupled to the anode; and a bearing assembly that rotatably supports the anode and the stem assembly, the bearing assembly including:

a hub coupled to the stem assembly, the hub defining a hub opening and an axis of rotation;

a shaft connected to the hub, the shaft including:

a first end received within the hub opening; and a shaft cavity formed in the first end, the shaft cavity including a bottom having a substantially curved transition area;

lower and upper bearing rings which cooperate with the shaft to define lower and upper races;

a lower ball set disposed in the lower race and an upper ball set disposed in the upper race; and a bearing housing configured to receive the lower and upper bearing rings, the lower and upper ball sets, and a portion of the shaft.

11. The x-ray tube of claim 10, wherein a diameter of a cylindrical portion of the shaft cavity is substantially equal to 10 millimeters.

12. The x-ray tube of claim 10, wherein the bottom of the shaft cavity is substantially semi-spherical in shape.

13. The x-ray tube of claim 10, wherein the stem assembly has a first coefficient of thermal expansion, the hub has a second coefficient of thermal expansion that is greater than the first coefficient of thermal expansion, and the shaft has a third coefficient of thermal expansion that is greater than the second coefficient of thermal expansion.

14. The x-ray tube of claim 10, wherein the hub includes first and second flanges that at least partially define the hub opening within which the first end of the shaft is received.

15. The x-ray tube of claim 10, wherein an axial length of a cylindrical portion of the shaft cavity is substantially equal to an axial length of the hub opening.

* * * * *